US006257158B1

(12) United States Patent
Asazuma et al.

(10) Patent No.: US 6,257,158 B1
(45) Date of Patent: Jul. 10, 2001

(54) SEWING MACHINE WITH UNCURLING DEVICE

(75) Inventors: Yoshiyuki Asazuma; Tadanori Inoue, both of Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/563,860

(22) Filed: May 4, 2000

(30) Foreign Application Priority Data

Jun. 18, 1999 (JP) ..... 11-173339

(51) Int. Cl.[7] ..... D05B 35/10
(52) U.S. Cl. ..... 112/153; 38/143
(58) Field of Search ..... 112/150, 141, 112/153, 276, 306; 38/143

(56) References Cited

U.S. PATENT DOCUMENTS 3,735,512 * 5/1973 Ross ..... 38/143
4,186,674 * 2/1980 Conner, Jr. ..... 112/153
4,590,876 * 5/1986 Mencke et al. ..... 112/153 X
4,928,610 * 5/1990 Akutsu ..... 112/153
5,046,272 * 9/1991 Vogt et al. ..... 38/143
5,437,238 * 8/1995 Price et al. ..... 112/153

FOREIGN PATENT DOCUMENTS 744310 10/1995 (JP) .

* cited by examiner

*Primary Examiner*—Ismael Izaguirre
(74) *Attorney, Agent, or Firm*—Birch, Stewart, Kolasch & Birch, LLP

(57) ABSTRACT

The invention provides a sewing machine with uncurling device comprising a separating plate and a suction tube, the separating plate is placed in front of the needle drop point and it separates upper and lower fabrics fed to a needle drop point with their respective edge hems overlapped, and the suction tube has an air-intake with its size covering across upper and lower surfaces of the separating plate and it straightens curls at separated edge hems of the both fabrics by air flow sucked into the suction tube through the air-intake. As the overlapped edge hems of the both fabrics are fed into the needle drop point, the curls at the edge hems are reliably straightened regardless of the shape thereof. Therefore, it eliminates troublesome manual labor for straightening the curls before feeding of the fabrics.

15 Claims, 6 Drawing Sheets

SEWING MACHINE WITH UNCURLING DEVICE

BACKGROUND OF THE INVENTION

The present invention relates to a sewing machine for sewing edge hems of an upper fabric and a lower fabric together that are fed to a needle drop point in an overlapped manner, and particularly to a sewing machine equipped with an uncurling device for straightening curls formed in the edge hems.

In performing sewing by using an overlock sewing machine for overedge-chain stitching edge hems of an upper fabric and a lower fabric that are fed to a needle drop point in an overlapped manner, particularly when the upper fabric and lower fabric are, i.e., knitted fabrics that tend to exhibit a tendency to curling, it would often be the case that both fabrics were fed to the needle drop point with their edge hems being curled to outside or inside and sewn together with these edge hems being in flapped conditions.

Such sewing causing degradations in qualities of obtained sewn articles, operators would manually straighten curls in the edge hems prior to feeding them into the needle drop point when performing sewing with the overlock sewing machine, which resulted in a great deal of work for this straightening. Further, in case the upper fabric and lower fabric are knitted materials or the like that are of rich elasticity, a drawback was presented in that high skill was required for straightening the curls without being accompanied by expansion of these fabrics.

An uncurling device that has been devised with the aim of solving these problems is disposed in Utility Model Examined Publication No. 7-44310(1995) co-owned by the applicant of the present invention, wherein the device is employed by being attached to a front portion of a needle drop point of a sewing machine for performing uncurling as once it had been manually performed by an operator.

Manual uncurling is performed through the following steps: a finger is inserted between the upper fabric and the lower fabric; other fingers are respectively placed on an upper surface of the upper fabric and a lower surface of the lower fabric for pinching the upper fabric and the lower fabric at proximities to their edge hems; and these pinched fabrics are fed to the needle drop point while the both edge hems are stretched by the fingers, thereby the curled portions are straightened (uncurled). The above uncurling device is arranged in that a plurality of straightening pieces that respectively simulate those fingers as used in the above manual operations is provided, in that the upper fabric and the lower fabric are pinched between these pieces, therefore uncurling is performed as feeding of both of the fabrics while the edge hems are stretched by the simulated fingers.

However, the uncurling device as disclosed in the above Utility Model Examined Publication 7-44310 is of complicated arrangement comprising the above plurality of straightening pieces (simulated fingers) and further comprising a mechanism for moving each of the straightening pieces up and down separately to pinch the upper fabric and lower fabric appropriately. Thus, the whole mechanism requires a bulky space in a front portion of the sewing machine.

Curls at the edge hems of fabrics that need to be straightened include outside curls with curls being formed at the edge hems of upper fabric or lower fabric in directions facing away from each other as well as inside curls with curls being formed in directions approaching towards each other. A drawback was consequently presented in that in the above uncurling device, forms for pinch-holding between the straightening pieces needed to be varied in accordance with combinations of curling shapes of the upper fabric and lower fabric and in that a great deal of work was required for setting upper fabric and lower fabric before sewing.

BRIEF SUMMARY OF THE INVENTION

The present invention has been made in view of the above problems, and it is an object of the present invention to provide a sewing machine with uncurling device capable of reliably straightening curls at edge hems of fabrics to be fed to a needle drop point in an overlapped manner regardless of shapes of these curls, and of simple arrangement requiring no troublesome work for setting the fabrics to be ready for uncurling.

A sewing machine with uncurling device of the first aspect according to the present invention is characterized by comprising: a separating plate, placed at front side of a needle drop point to be inserted between an upper fabric and a lower fabric that are fed to the needle drop point with respective edge hems being overlapped, for separating the edge hems in vertical directions; and a suction tube having an air-intake whose opening is opposing to the tip of the edge hems and whose opening is placed across the upper and lower surfaces of the separating plate, wherein curls at the edge hems of the upper fabric and lower fabric are straightened by using air flow sucked into the air-intake of the suction tube which is connected to an air-suction source.

According to the present invention, the upper fabric and lower fabric fed to the needle drop point are separated by the separating plate being inserted between these fabrics, and upon suction of air by the suction tube, ambient air is sucked through the air-intake whose opening is placed across the upper surface and the lower surface of the separating plate. In this manner, the curls at edge hems of the upper fabric and lower fabric are separated by the separating plate are pulled by the air flow towards the air-intake and are thus straightened.

The sewing machine with uncurling device of the second aspect according to the present invention is characterized in that the separating plate includes: an action piece being inclined with its tip end facing forward; and guide tips attached to both surfaces of the action piece with their thicknesses descending toward the tip end of the action piece.

According to this invention, a forwardly inclining action piece is provided at the tip end of the separating plate with its thickness decreasing toward the tip end, wherein the preliminarily placed upper fabric and lower fabric are separated by sliding guidance of the action piece while feeding these fabrics, and thus the fabrics are reliably introduced to above and below the separating plate. The decrease in thickness at the tip end of the action piece is achieved by the guide tips having sloped surfaces on one side thereof that are attached to both upper and lower surfaces of the action piece, wherein appropriate guidance is performed by adjusting positions of the guide tips on the action piece.

The sewing machine with uncurling device of the third aspect according to the present invention is characterized by further comprising: a guide lever, placed in front of the separating plate, for guiding either or both of an upper surface of the upper fabric and a lower surface of the lower fabric.

According to this invention, a guide lever disposed in a front position of the separating plate is made to abut against either or both of the upper surface of the upper fabric and the lower surface of the lower fabric, therefore it preliminarily guides these fabrics to straighten outside curls.

Furthermore, the sewing machine with uncurling device of the fourth aspect according to the present invention is characterized by further comprising: an adjustor for adjusting flow rate of air sucked into the suction tube.

According to this invention, it is provided with an adjustor for adjusting flow rate of air sucked into the suction tube, and by performing adjustments of suction rate of air in accordance with types or thicknesses of the fabrics, curls at edge hems can be reliably straightened.

The above and further objects and features of the invention will more fully be apparent from the following detailed description with accompanying drawings.

DETAILED DESCRIPTION OF THE INVENTION

The present invention will now be explained in details based on drawings illustrating embodiments thereof.

Figure 1:
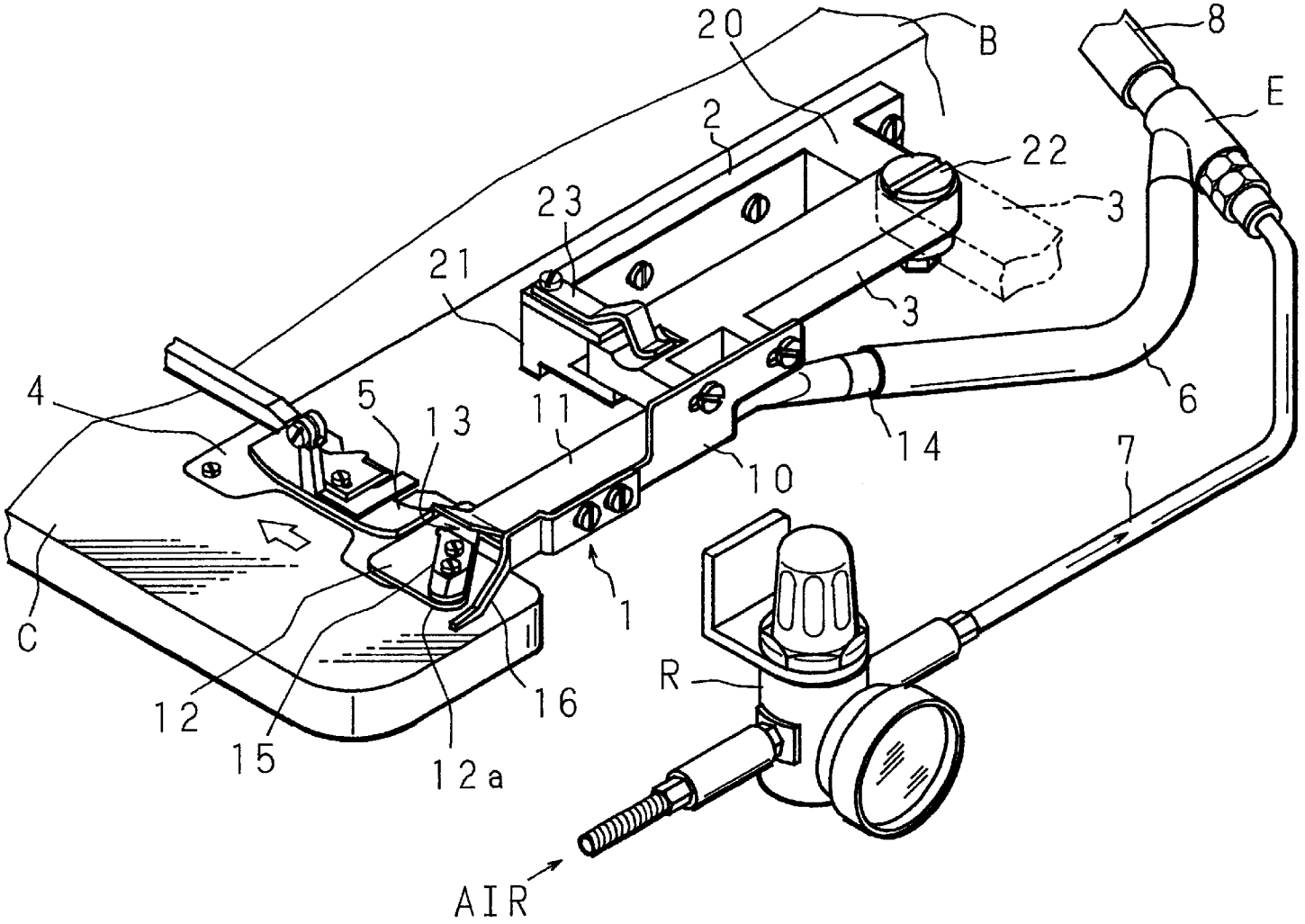
FIG. 1 is a perspective view showing a configuration of an essential part of a sewing machine with uncurling device according to the present invention.

FIG. 1 is a perspective view showing a configuration of an essential part of the sewing machine with an uncurling device according to the present invention. As illustrated in the drawing, an uncurling device 1 is attached to a front surface of a sewing bed B of an overlock sewing machine by means of a stationary supporting plate 2 and an operational supporting plate 3.

A needle plate 4 is provided in a bridging manner on an upper surface on one end portion (left end portion) of the sewing bed B while a cross plate C is provided around the needle plate 4. Sewing by using the overlock sewing machine is performed by pinching an upper fabric $W_1$ and a lower fabric $W_2$ that are fed onto the cross plate C in a vertically overlapped manner (see FIG. 2, FIG. 5, and FIG. 6) between the needle plate 4 and a presser plate 5, and while applying feeding force in a direction as indicated by the hollow arrow in the drawing, edge hems of both fabrics $W_1$, $W_2$ are overedge-chain stitched by synergistic motions of a needle and a looper (not shown).

The stationary supporting plate 2 is fixed to extend along the front surface of the sewing bed B by means of three fixing screws each located in the center and on the right and left thereof, and a supporting protrusion 20 and a stopper protrusion 21 are provided on both lateral sides thereof to protrude frontward. The operational supporting plate 3 is arranged in that one end thereof is pivotally supported by means of a hinge shaft 22 at a tip end portion of the supporting protrusion 20 and is attached to be swingable in a substantially horizontal plane around the hinge shaft 22. Thus, the operational supporting plate 3 may assume either an operational position with the other end abutting against the stopper protrusion 21 so as to be substantially parallel to the stationary supporting plate 2 as illustrated by the solid line in the drawing or a retracted position in which the operational supporting plate 3 is opened so as to be substantially orthogonal to the stationary supporting plate 2 when not in use as illustrated by the two-dot chain line in the drawing.

It should be noted that the operational supporting plate 3 in the operational position is arranged in that the other end is engaged with and restrained by a hinge spring 23 fixed to an upper surface of the stopper protrusion 21, and for moving to the retracted position, a pulling force in a frontward direction is applied to the other end of the operational supporting plate 3 for disengaging the engagement with the hinge spring 23.

The uncurling device 1 is arranged in that it comprises a fixed plate 10 fixed to a front surface of the operational supporting plate 3 through clamping by a pair of laterally arranged fixing screws, a suction tube 11 integrally formed along a rear surface of the fixed plate 10, and a separating plate 12 connectedly provided at one end portion (left end portion) of the suction tube 11.

Figure 2:
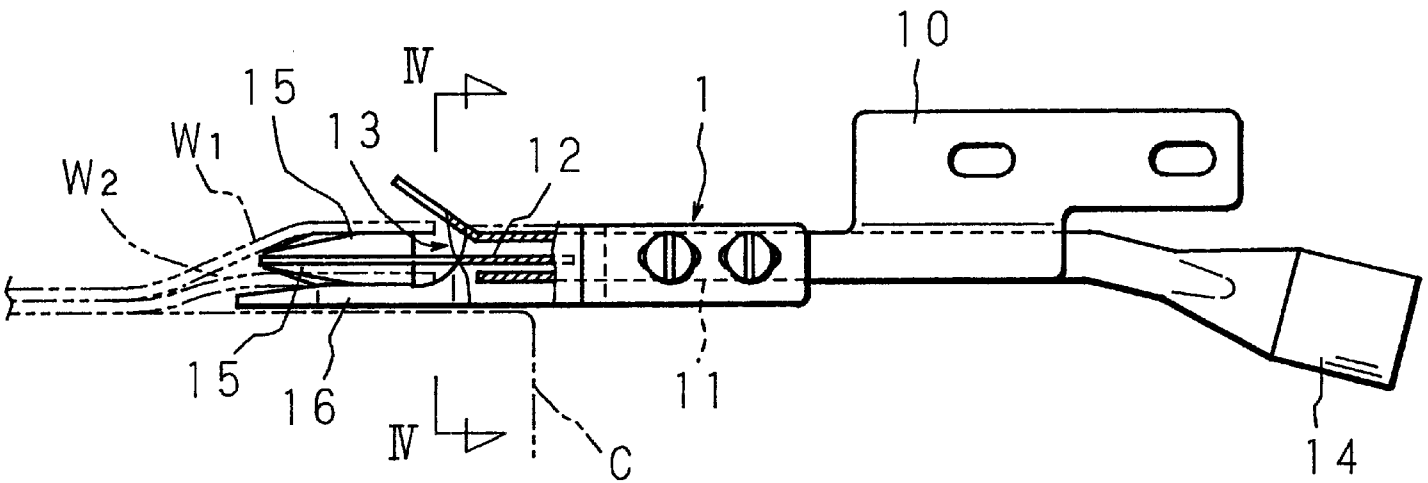
FIG. 2 is a partial cutaway front view of an essential part of the sewing machine with uncurling device according to the present invention.
Figure 3:
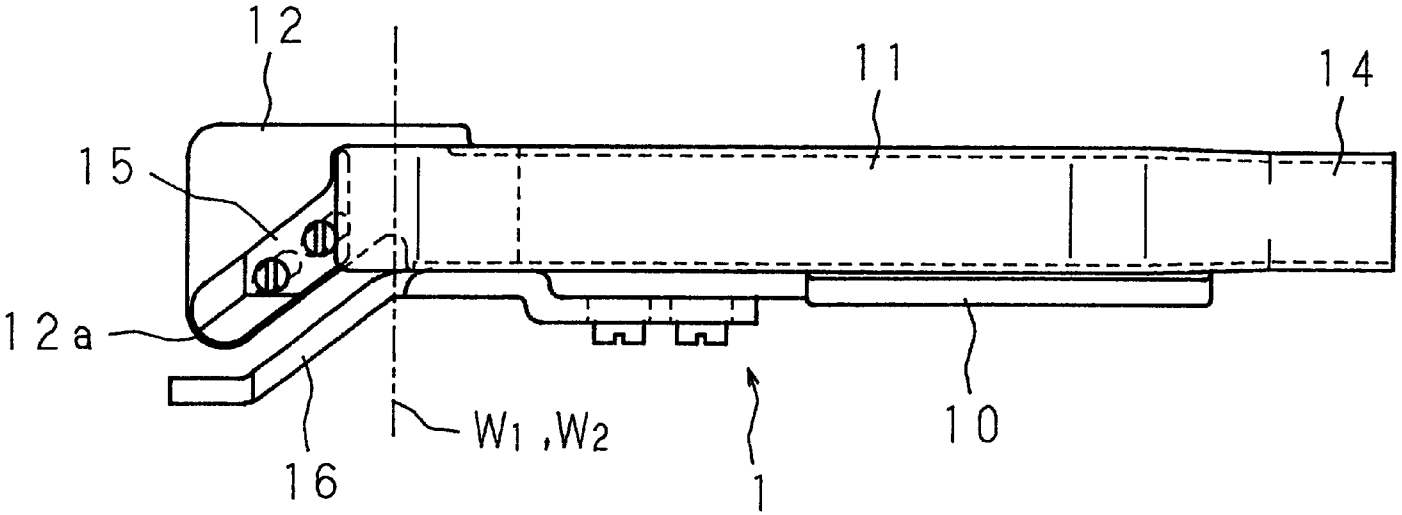
FIG. 3 is a plan view of an essential part of the sewing machine with uncurling device according to the present invention.
Figure 4:
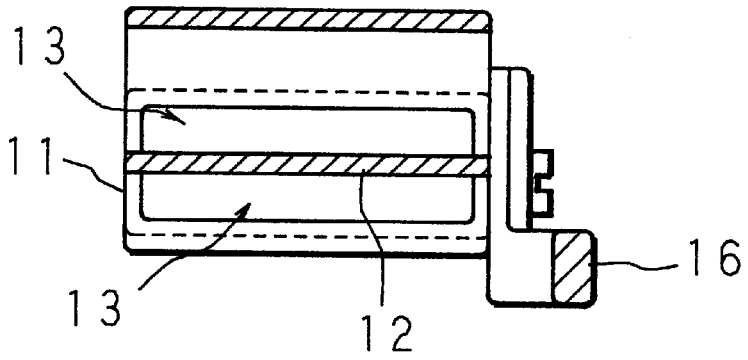
FIG. 4 is a transverse sectional view along line IV—IV of FIG. 2.

FIG. 2 is a partial cutaway front view of an essential part of the uncurling device 1, FIG. 3 a plan view thereof, and FIG. 4 is a transverse sectional view along line IV—IV of FIG. 2. As illustrated in these drawings, the suction tube 11 that is fixedly provided on the rear surface of the fixed plate 10 is a cylindrical body having a rectangular section with a narrow width in vertical directions and with a wide width in front and rear directions. The separating plate 12 is connectedly provided at the one end portion of the suction tube 11 to divide across substantially its center in the vertical directions, and an air-intake 13 that is open to form a rectangular section is formed across the upper surface and the lower surface of the separating plate 12.

A connecting tube 14 with a circular section is integrally connected to the other end portion (right end portion) of the suction tube 11 wherein this connecting tube 14 is connected to ejector E through air-supplying hose 6 as illustrated in FIG. 1. The ejector E is a conventionally known mechanical element for ejecting gas (air) through an incorporated nozzle and for vacuuming the air by actions of the blowing air, wherein the blowing air is ejected through the incorporated nozzle of the ejector connected to an air-supplying source (not shown) through an air-supplying pipe 7 with a regulator R interposed halfway thereof and by supplying air whose amount is adjusted by the regulator R.

In the suction tube 1 connected to the ejector E through the air-supplying hose 6 and the connecting tube 14, ambient air is sucked through the air-intake 13 in accordance with the ejecting air from the ejector E, this sucked air is introduced into the ejector E through the connecting tube 14 and the air-supplying hose 6 and finally exhausted together with the ejecting air through an exhaust hose 8. The air-intake 13 of the suction tube 11 has its opening in a span from the upper surface to the lower surface of the separating plate 12 such that sucked air as generated in the above manner flows along these upper and lower surfaces of the separating plate 12 before it is sucked by the suction tube 11.

The flow rate of sucked air can be adjusted by the regulator R for adjusting the flow rate of air that is fed through the air-supplying pipe 7 with a predetermined pressure, and this regulator R performs actions of an adjustor for the flow rate of sucked air. If it should be possible to employ an air-suction source such as a suction pump or the like, it is also possible to employ an arrangement in which the air-supplying hose 6 is connected to the vacuum source for making the hose directly perform the air suction. In this case, adjustments in the flow rate of sucked air can be performed directly by adjusting outputs of the vacuum source.

In this manner, the tip end portion of the suction tube 11 is located on a front side of the needle drop point placed at an overlapping portion of the needle plate 4 and presser plate 5 when the operational supporting plate 3 is restrained in the operational position as illustrated in FIG. 1. The separating plate 12 connectedly arranged at the tip end of the suction tube 11 is positioned with a predetermined distance from the upper surface of the cross plate C at the tip end of the sewing bed B so as to be substantially parallel thereto.

An action piece 12*a* inclining with the tip end facing forward (frontward when seen from the front side of the sewing machine) is integrally formed with such a separating plate 12 in an protruding manner as illustrated in FIG. 1 and FIG. 3, two guide tips 15 each with tapered surfaces being formed on both sides in width directions so as to be thin at respective tip ends thereof are attached to both upper and lower surfaces of the acting piece 12*a*. Therefore, the acting piece 12*a* has a predetermined overall thickness but with its thickness decreasing toward the tip end as illustrated in FIG. 2.

A guide lever 16 is disposed in front of the separating plate 12. This guide lever 16 is attached with its base portion being screw-fastened to a front edge of the fixed plate 10 and is arranged so as to extend somewhat forward along the front edge of the acting piece 12*a* at a position just below the lower surface of the separating plate 12 and bent at its intermediate portion in a bridging manner as to extend along the front edge of the cross plate C.

In the uncurling device 1 of the above-described arrangement, the upper and lower fabrics $W_1$, $W_2$ that are fed to the needle drop point in the above-described manner are set with the lower fabric $W_2$ being placed on the guide lever 16 and passed below the separating plate 12 and with the upper fabric $W_1$ being placed on the separating plate 12 while respective edge hems thereof are made to face the air-intake 13 of the suction tube 11. When feeding force is applied to the upper and lower fabrics $W_1$, $W_2$ while suction of air is performed by the suction tube 11, the upper fabric $W_1$ and lower fabric $W_2$ are separated to above and below the separating plate 12 respectively while the feeding is proceeding, and they are repeatedly overlapped at a rear side of the separating plate 12 to be pinch-held by the needle plate 4 and the presser plate 5 to be ready for overedge-chain stitching.

It should be noted that the separating plate 12 is provided with the action piece 12*a* inclining in a forward direction and being decreased in its thickness at its tip end by means of the guide tips 15, such that separating of the upper fabric $W_1$ and lower fabric $W_2$ while the feeding can be favorably performed by these actions.

Figure 5:
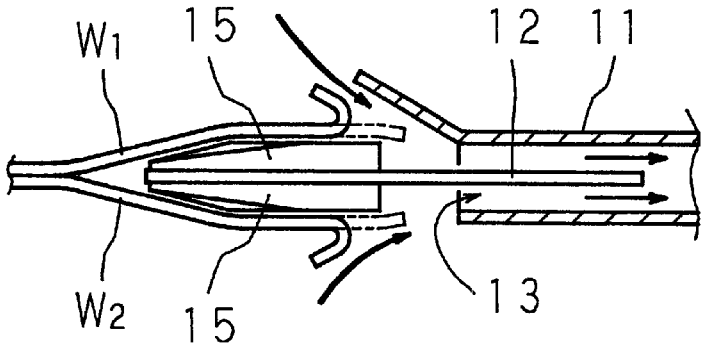
FIG. 5 is a view for explaining operations of the sewing machine with uncurling device according to the present invention.
Figure 6:
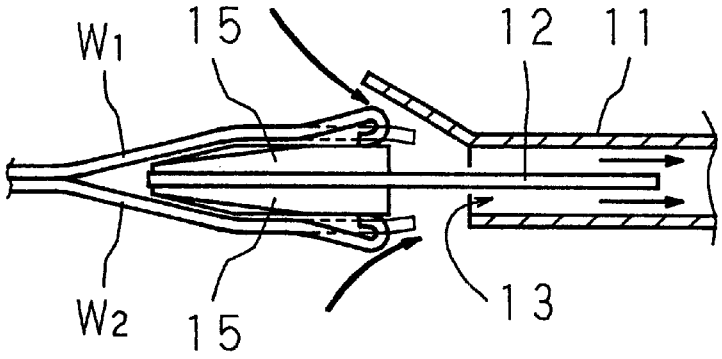
FIG. 6 is a view for explaining operations of the sewing machine with uncurling device according to the present invention.

FIG. 5 and FIG. 6 are views for explaining operations of the uncurling device 1 with the tip end portion of the suction tube 11 enlarged. It may be that outside curls as illustrated in FIG. 5 or inside curls as illustrated in FIG. 6 are formed at the edge hems of upper and lower fabrics $W_1$, $W_2$ as set in the above-described manner, and while the fabrics $W_1$, $W_2$ are separated to above and below the separating plate 12, a flow of sucked air is generated above and below the separating plate 12 that is directed into the air-intake 13 of the suction tube 11. This flow of sucked air acting over the curls straightens the curls while it is sucked into the air-intake 13 as represented by the two-dot chain line in the drawings.

It should be noted that the inside curls at the edge hems of the upper fabric $W_1$ and lower fabric $W_2$ as illustrated in FIG. 6 are straightened in an auxiliary manner by being mounted on the guide tips 15 that are attached to both surfaces of the action piece 12*a* of the separating plate 12 as to increase in its thickness toward the rear thereof, while an outside curl at the edge hem of the lower fabric $W_2$ as illustrated in FIG. 5 is straightened in an auxiliary manner by being mounted on the guide lever 16 disposed frontward of the separating plate 12. It should be noted that while only the guide lever 16 for guiding the lower surface of the lower fabric $W_2$ is provided in the above-described embodiment, it is also possible to provide another guide lever in front of the separating plate 12 to be provided at a somewhat above the upper surface of the separating plate 12 in a bridging manner for guiding the upper surface of the upper fabric $W_1$ in a similar fashion.

The flow rate of air sucked into the suction tube 11 is suitably adjustable by operating the regulator R, wherein such adjustments may be differently performed depend on the types and thicknesses of the upper and lower fabrics $W_1$, $W_2$ to thereby enabling appropriate uncurling by the actions of sucked air. It should also be noted it is also possible to employ an arrangement in which operations of the regulator R are performed by an appropriate actuator for performing operations in accordance with set values for the types and thicknesses of the fabrics to thus adjust flow rate of sucked air automatically.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalences of such metes and bounds thereof are therefore intended to be embraced by the claims.

What is claimed is:

1. A sewing machine with uncurling device comprising:

a separating plate, said separating plate being placed at a front side of a needle drop point and insertable between an upper fabric and a lower fabric that are fed to the needle drop point with respective edge hems being overlapped, said separating plate for separating the edge hems in a vertical direction; and a suction tube having an air-intake opening opposing a tip of each of the edge hems, said suction tube being placed across the upper surface and the lower surface of the separating plate and connected to an air-suction source, wherein curls at the edge hems of the upper fabric and lower fabric are straightened by air flow sucked into the suction tube through the air-intake openings.

2. The sewing machine with uncurling device according to claim 1, wherein said separating plate includes:

an action piece inclined with a tip end thereof facing forward; and guide tips attached to upper and lower surfaces of the action piece, said guide tips having a thickness descending toward the tip end of the action piece.

3. The sewing machine with uncurling device according to claim 1, further comprising:

a guide lever, said guide lever being placed in front of said separating plate for guiding either or both of an upper surface of the upper fabric and a lower surface of the lower fabric.

4. The sewing machine with uncurling device according to claim 1, further comprising:

an adjustor for adjusting a flow rate of air sucked into the suction tube.

5. The sewing machine with uncurling device according to claim 2, further comprising:

a guide lever, said guide lever being placed in front of said separating plate for guiding either or both of an upper surface of the upper fabric and a lower surface of the lower fabric.

6. The sewing machine with uncurling device according to claim 2, further comprising:

and adjusting a flow rate of air sucked into the suction tube.

7. The sewing machine with uncurling device according to claim 3, further comprising:

an adjustor for adjusting a flow rate of air sucked into the suction tube.

8. The sewing machine with uncurling device according to claim 1, wherein said separating plate extends into said suction tube to form said air intake openings on the upper and lower surfaces of said separating plate.

9. The sewing machine with uncurling device according to claim 1, further comprising:

a stationary supporting plate fixed to a bed of said sewing machine; and an operational supporting plate pivotally supported by said stationary supporting plate, said separating plate and said suction tube being supported by said operational supporting plate and pivotable therewith from an operational position to an inoperable position.

10. An uncurling device for a sewing machine, comprising:

a separating plate, said separating plate being locatable at a front side of a needle drop point of the sewing machine and insertable between an upper fabric and a lower fabric that are fed to the needle drop point with respective edge hems being overlapped, said separating plate for separating the edge hems in a vertical direction; and a suction tube having an air-intake opening opposing a tip of each of the edge hems, said suction tube being placed across the upper surface and the lower surface of the separating plate and connectable to an air-suction source;

wherein curls at the edge hems of the upper fabric and lower fabric are straightened by air flow sucked into the suction tube through the air-intake openings.

11. The uncurling device for a sewing machine according to claim 10, wherein said separating plate includes:

an action piece inclined with a tip end thereof facing forward; and guide tips attached to upper and lower surfaces of the action piece, said guide tips having a thickness descending toward the tip end of the action piece.

12. The uncurling device for a sewing machine according to claim 10, further comprising:

a guide lever, said guide lever being placed in front of said separating plate for guiding either or both of an upper surface of the upper fabric and a lower surface of the lower fabric.

13. The uncurling device for a sewing machine according to claim 11, further comprising:

a guide lever, said guide lever being placed in front of said separating plate for guiding either or both of an upper surface of the upper fabric and a lower surface of the lower fabric.

14. The uncurling device for a sewing machine according to claim 10, wherein said separating plate extends into said suction tube to form said air intake openings on the upper and lower surfaces of said separating plate.

15. The uncurling device for a sewing machine according to claim 10, further comprising:

a stationary supporting plate fixable to a bed of said sewing machine; and an operational supporting plate pivotally supported by said stationary supporting plate, said separating plate and said suction tube being supported by said operational supporting plate and pivotable therewith from an operational position to an inoperable position.

* * * * *